US006284991B1

(12) United States Patent
Fasano et al.

(10) Patent No.: US 6,284,991 B1
(45) Date of Patent: Sep. 4, 2001

(54) FRONT MOUNTING CIRCUIT BREAKER BRACKET ASSEMBLY

(75) Inventors: Michael A. Fasano, Waterbury; James Bugryn, Bristol, both of CT (US)

(73) Assignee: Carlingswitch, Inc., Plainville, CT (US)

( * ) Notice: Subject to any disclaimer, the term of this patent is extended or adjusted under 35 U.S.C. 154(b) by 0 days.

(21) Appl. No.: 09/648,842

(22) Filed: Aug. 25, 2000

(51) Int. Cl.[7] ..... H01H 9/02
(52) U.S. Cl. ..... 200/296; 335/202
(58) Field of Search ..... 200/293, 294, 200/295, 296; 248/27.1, 27.3; 335/202

(56) References Cited

U.S. PATENT DOCUMENTS 4,045,650 * 8/1977 Nestor ..... 200/153 K
4,454,565 6/1984 Krasij et al. ..... 361/376
5,438,483 8/1995 Fasano et al. ..... 361/825

* cited by examiner

*Primary Examiner*—Lincoln Donovan
*Assistant Examiner*—Nhung Nguyen
(74) *Attorney, Agent, or Firm*—McCormick, Paulding & Huber LLP

(57) ABSTRACT

A circuit breaker bracket assembly has two generally U-shaped metal clips, each metal clip having a rearwardly projecting resilient wing formed therein with two forwardly projecting arms extending therefrom, each arm having an aperture which engages a nodule of a recess on a basal portion of a molded plastic cover plate. The molded plastic cover plate has a top face which has flanges preventing the cover plate from sliding through a panel opening. The basal portion has two mounting plugs formed on the back thereof which engage openings in each circuit breaker half case part and upon assembly of the circuit breaker holds the circuit breaker bracket assembly to the circuit breaker case.

8 Claims, 3 Drawing Sheets

FRONT MOUNTING CIRCUIT BREAKER BRACKET ASSEMBLY

BACKGROUND OF THE INVENTION

The present invention relates generally to the mounting of circuit breakers in panel openings. In particular, the present invention relates to a circuit breaker bracket assembly designed to mount a conventional split case circuit breaker in a panel opening from the front. Conventional circuit breakers are typically mounted on the rear of the panel through small openings designed to receive a boss on the front of the breaker.

Circuit breakers having bracket assemblies designed with resilient wings to facilitate front mounting in panel openings are known. Such wings, typically, are not removable nor do they snap into place. U.S. Pat. No. 5,438,483 issued to Fasano et al. on Aug. 1, 1995 discloses a bracket assembly, for front mounted circuit breakers, which has rearwardly projecting metal wings mounted in a plastic cover plate. Fasteners secure the metal wings to the breaker housing thus securing the cover plate to the breaker. A pair of resilient wings is fixed by tabs with screws, or rivets, on each side of each end of the circuit breaker.

Bracket assemblies similar to adapter plates have been used with circuit breakers permitting smaller circuit breakers to be mounted in panels designed for larger circuit breakers thus eliminating the need for panel replacement. U.S. Pat. No. 4,454,565 issued to Krasij et al. on Jun. 12, 1984 describes an adapter plate for use with a conventional circuit breaker. The adapter plate therein allows a smaller circuit breaker to be used with a panel opening intended to receive larger breakers. The invention of '565 is for rear mounting a circuit breaker in a panel opening, not for front mounting. Although only one screw is used to hold the adapter plate to the circuit breaker, the same screw is used to hold the adapter plate in position relative to the circuit breaker and to the panel opening, and an additional screw is used to secure the adapter plate to the panel opening. This type requires the circuit breaker/adapter plate to be assembled concurrently with mounting the circuit breaker.

None of the above inventions and patents, taken either singularly or in combination, is seen to describe the instant invention as claimed.

SUMMARY OF THE INVENTION

The present invention is a circuit breaker bracket assembly designed to mount a conventional split case circuit breaker in a panel opening from the front. The bracket assembly has a molded plastic cover plate which has a rectangular opening therein for receiving an actuator means, a basal portion which has a length such that the basal portion of the cover plate slides snugly into the panel opening, a top face which has flanges extending therefrom abutting the panel's front face adjacent the ends of the panel opening preventing the cover plate from sliding through the panel's front face, an attachment means which firmly attaches the cover plate to the split case circuit breaker, and a means for retaining the cover plate in the panel's front face.

The object of the invention is to provide a circuit breaker bracket assembly which permits the front mounting of a circuit breaker, which is normally rear mounted, into a panel opening.

Another object of the invention is to provide a bracket assembly which can be used as a front mounting adapter plate permitting circuit breakers which are the same size or smaller to be used in the same panel.

It is a further object of the invention to provide an easily assembled, sturdy circuit breaker bracket assembly for front mounting circuit breakers.

These and other objects of the present invention will become readily apparent upon further review of the following drawings and specification.

DETAILED DESCRIPTION OF THE PREFERRED EMBODIMENTS

Figure 2:
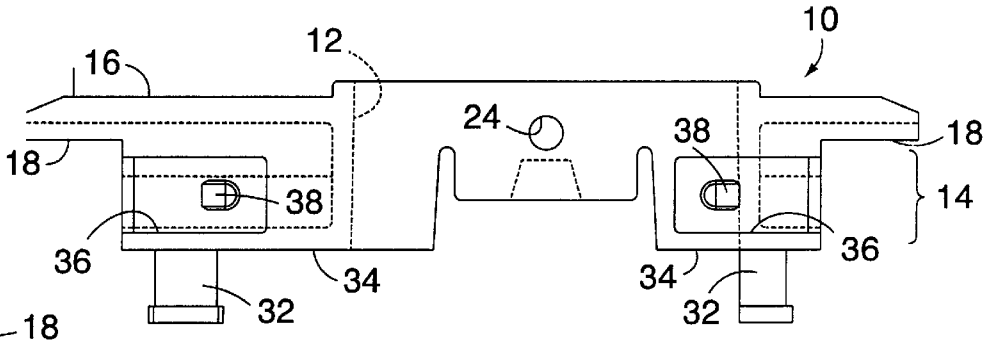
FIG. 2 is a side view of one embodiment of a cover plate according to the present invention.

The preferred embodiment of the circuit breaker bracket assembly for front mounting a split case circuit breaker in a rectangular panel opening has a molded plastic cover plate 10. The molded plastic cover plate 10 has a rectangular opening 12 therein for receiving an actuator means, a basal portion 14 which has a length such that the basal portion 14 of the cover plate 10 slides snugly into the panel opening (not shown), a top face 16 which has flanges 18 extending therefrom abutting the panel's front face (not shown) adjacent the ends of the panel opening (not shown) preventing the cover plate 10 from sliding through the panel's front face, an attachment means which firmly attaches the cover plate to the split case circuit breaker, and a means for retaining the cover plate in the panel's front face.

A preferred actuator means is a circuit breaker handle or toggle extending through the rectangular opening 12 of the cover plate. This embodiment utilizes a standard actuator (not shown) which is attached to the conventional circuit breaker. The cover plate 10 which utilizes the standard actuator is shown in FIGS. 2 and 3.

Figure 5:
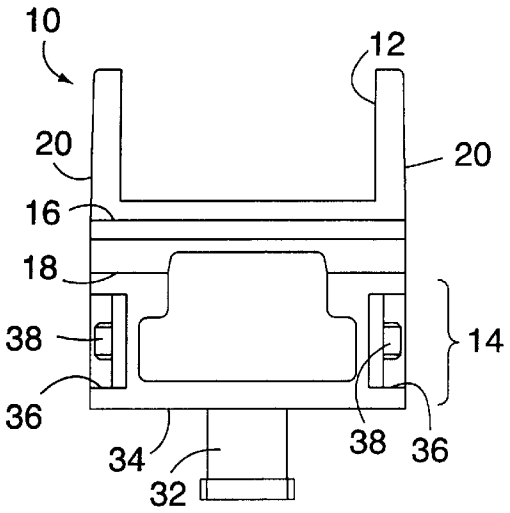
FIG. 5 is a front view of the embodiment of the cover plate shown in FIG. 4.
Figure 4:
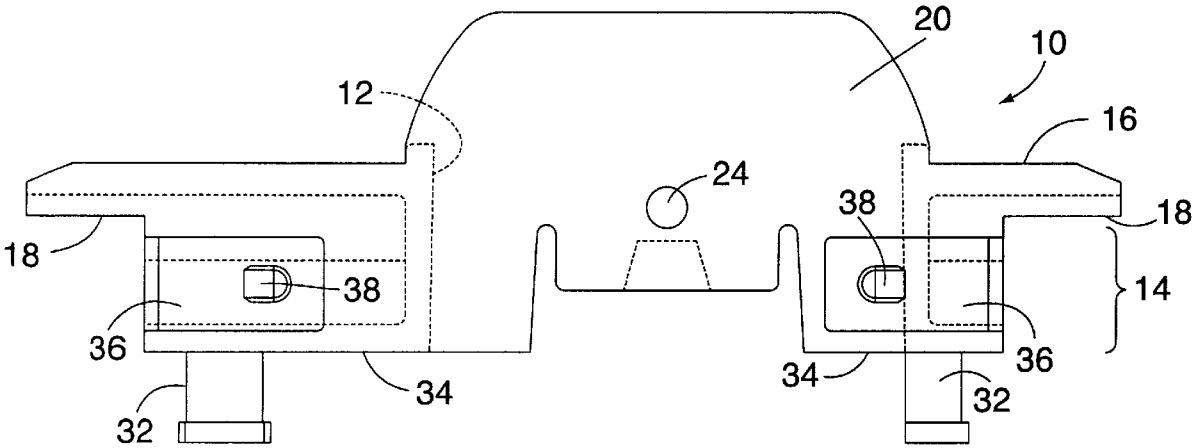
FIG. 4 is a side view of another embodiment of a cover plate according the present invention.
Figure 10:
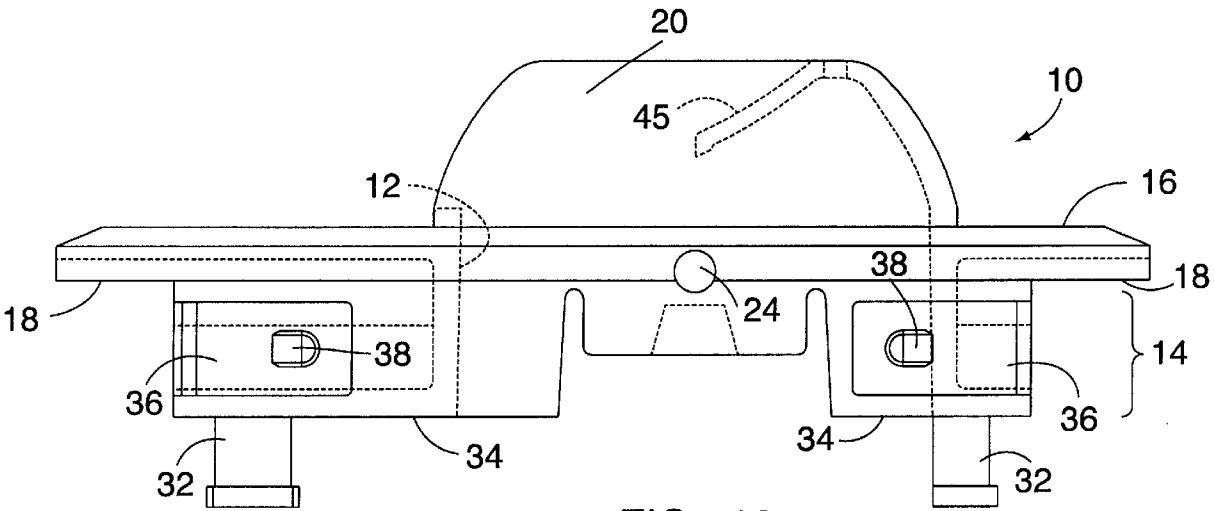
FIG. 10 is a side view of a cover plate which is a modification of the cover plate shown in FIG. 4.
Figure 6:
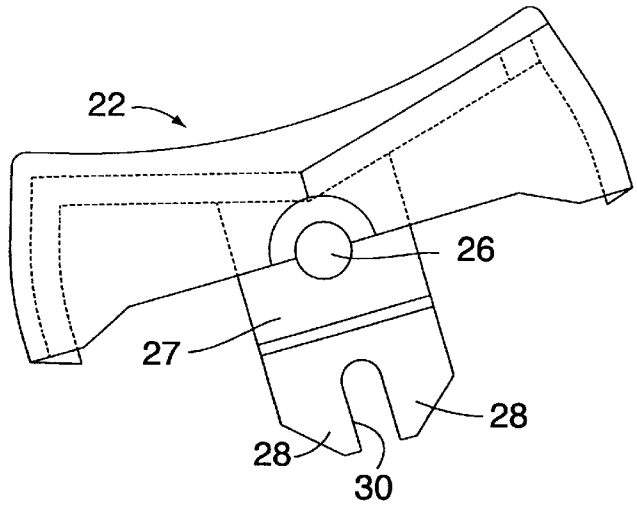
FIG. 6 is a side view of a rocker actuator utilized with the embodiment of the current invention shown in FIG. 4.

In another embodiment, the rectangular opening has two side walls 20 extending upwardly therefrom, as shown in FIGS. 4 and 5, and a rocker 22, shown in FIG. 6, is pivotably mounted on the side walls 20 in the rectangular opening 12 of the embodiment depicted in FIGS. 4 and 5. The rocker 22 defines projecting integrally formed axle portions 26 received in aligned apertures 24 provided for them in the walls 20 defining the apertures 24, as shown. The rocker 22 has a depending yoke 27 integrally formed therein. The yoke 27 has laterally spaced legs 28 that define downwardly open slots 30 aligned with one another for receiving a cross pin end portion (not shown) to provide pivotal motion of the actuator link of the circuit breaker (not shown) generally opposite that of the rocker 22. FIG. 10 shows another embodiment of a cover plate 10, according to the present invention, which is rocker actuated and has a guard 45 over one side of the rectangular opening, as shown.

The preferred attachment means, for firmly attaching the cover plate 10 to the split case circuit breaker A, has two mounting plugs 32 formed on the back 34 of the basal portion 14 to engage aligned openings of each circuit breaker half case part (not shown) such that when the circuit breaker case A is assembled the cover plate 10 is firmly attached to the split case circuit breaker. This attachment means enables the use of the present invention with different sized split case circuit breakers provided the circuit breaker is not larger than the panel opening, and the mounting plugs 32 are spaced to engage the aligned openings of the circuit breaker used.

Figure 3:
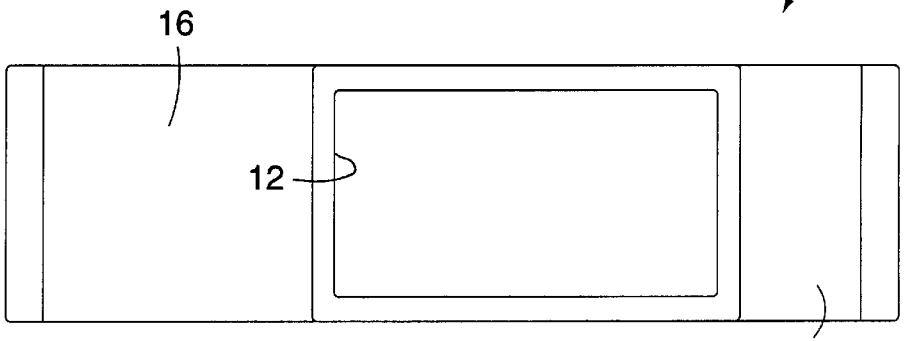
FIG. 3 is a top view of the embodiment of the cover plate of FIG. 2.
Figure 1:
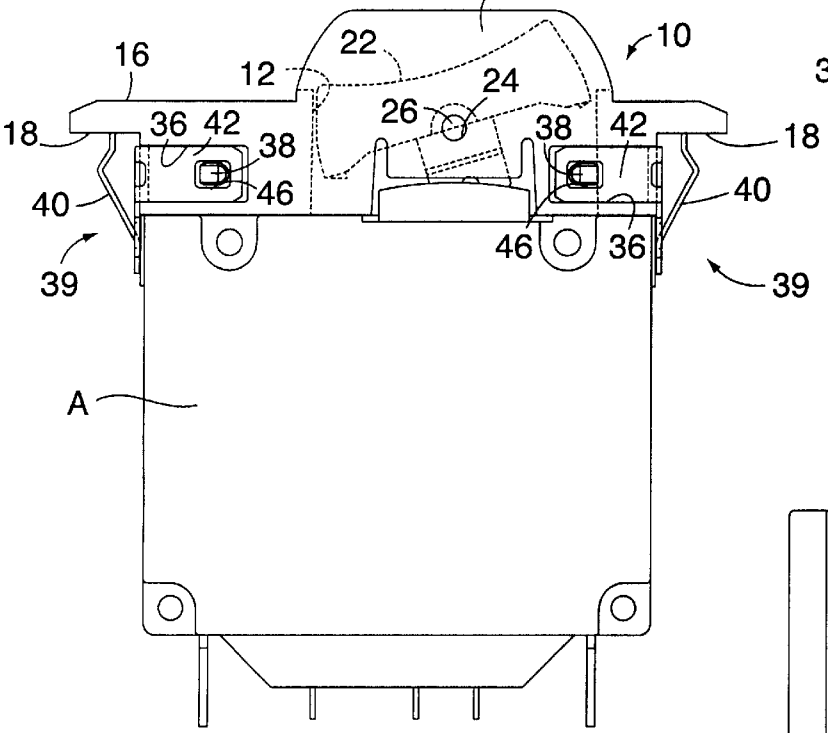
FIG. 1 is a side view of one embodiment of a circuit breaker bracket assembly, according to the present invention, as attached to a split case circuit breaker.
Figure 7:
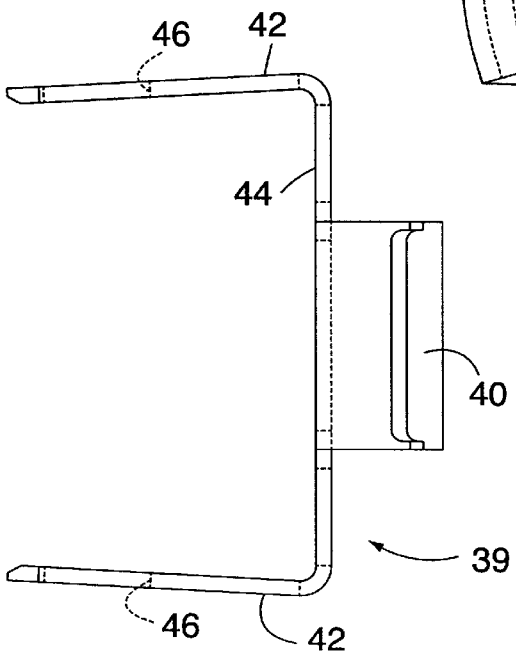
FIG. 7 is a top view of a generally U-shaped metal clip according to the present invention.
Figure 8:
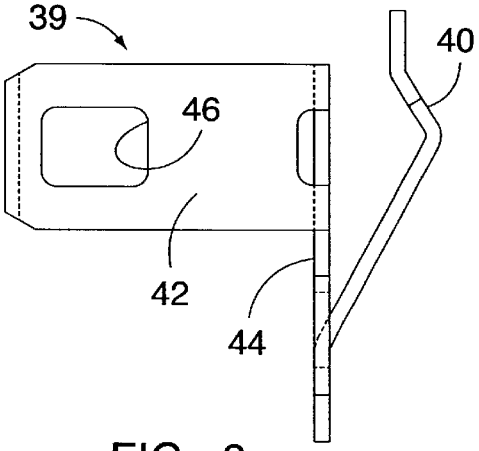
FIG. 8 is a side view of the U-shaped metal clip shown in FIG. 7.
Figure 9:
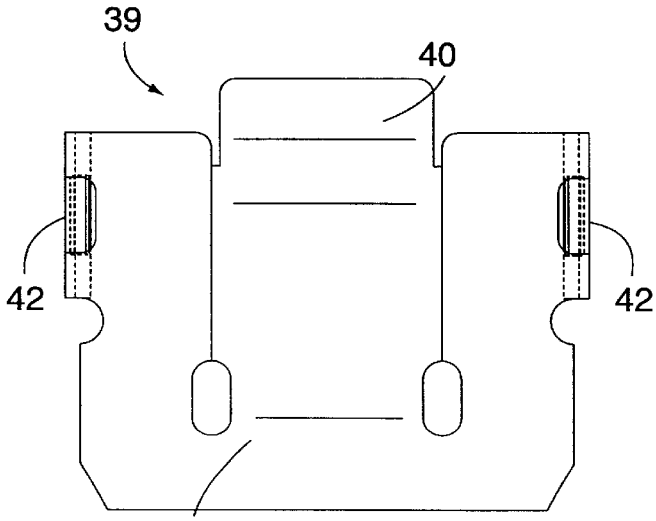
FIG. 9 is a front view of the U-shaped metal clip shown in FIG. 7.

The preferred means for retaining the cover plate in the panel's front face comprises parallel recesses 36 shown in FIGS. 2, 4, and 5 and two generally U-shaped metal clips 39 shown in FIGS. 7 and 8. The parallel recesses 36 are disposed adjacent each end of the basal portion 14, as shown, and have a nodule 38 disposed in each recess 36. Each of the generally U-shaped metal clips 39 has a body with a rearwardly projecting resilient wing 40 formed therein, and two forwardly projecting arms 42. The two forwardly projecting arms 42 extend roughly parallel to one another from either side of the body 44, as shown in FIG. 9. Each arm 42 has an aperture 46 which engages the nodule 38 in one of the recesses 36 such that the resilient wings 40 abut the ends of the basal portion 14 of the cover plate 10 when the clips 39 are disposed thereon. The U-shaped metal clips 39 are firmly held in place relative to the cover plate 10. When the cover plate 10 is engaged in the panel opening, the resilient wings 40 securely hold the cover plate 10 and any circuit breaker attached thereto in place.

It is to be understood that the present invention is not limited to the embodiments described above, but encompasses any and all embodiments within the scope of the following claims.

What is claimed is:

1. A bracket assembly for front mounting a split case circuit breaker in a panel having a front face and a rectangular panel opening, which panel opening has two ends, said bracket assembly comprising:

a molded plastic cover plate having a rectangular opening therein for receiving an actuator means, a basal portion having a length such that the basal portion of said cover plate slides snugly into the panel opening, a top face having flanges extending therefrom for abutting the panel's front face adjacent the ends of the panel opening preventing said cover plate from sliding through the panel's front face, an attachment means for firmly attaching said cover plate to the split case circuit breaker, and a means for retaining said cover plate in the panel's front face.

2. The bracket assembly of claim 1, wherein:

said attachment means for firmly attaching said cover plate to the split case circuit breaker comprises two mounting plugs formed on the back of the basal portion to engage aligned openings of each circuit breaker half case part such that when the circuit breaker case is assembled said cover plate is firmly attached to the split case circuit breaker.

3. The bracket assembly of claim 1, wherein:

said means for retaining said cover plate in the panel's front face comprises parallel recesses disposed adjacent each end of the basal portion having a nodule disposed in each recess; and two generally U-shaped metal clips wherein each has a body with a rearwardly projecting resilient wing formed therein, and two forwardly projecting arms extending roughly parallel to one another from either side of the body, each arm having an aperture for engaging the nodule in one of the recesses such that the resilient wings abut the ends of the basal portion of said cover plate when said clips are disposed thereon.

4. The bracket assembly of claim 1, wherein:

said actuator means comprises a circuit breaker handle or toggle extending through the rectangular opening of said cover plate.

5. The bracket assembly of claim 1, wherein:

the rectangular opening has two side walls extending upwardly therefrom; and said actuator means comprises a rocker pivotably mounted in the rectangular opening, said rocker defining projecting integrally formed axle portions received in aligned apertures provided for them in the walls defining the apertures, said rocker having a depending yoke integrally formed therein and the yoke having laterally spaced legs that define downwardly open slots aligned with one another.

6. A bracket assembly for front mounting a split case circuit breaker in a panel having a front face and a rectangular panel opening, which panel opening has two ends, said bracket assembly comprising:

a molded plastic cover plate having a rectangular opening therein for receiving an actuator means, a basal portion having a length such that the basal portion of said cover plate slides snugly into the panel opening, a top face having flanges extending therefrom abutting the panel's front face adjacent the ends of the panel opening preventing said cover plate from sliding therethrough, two mounting plugs formed on the back of the basal portion to engage aligned openings of each circuit breaker half case part such that when the circuit breaker case is assembled said cover plate is firmly attached to the split case circuit breaker, and parallel recesses disposed adjacent each end of the basal portion having a nodule disposed in each recess; and two generally U-shaped metal clips wherein each has a body with a rearwardly projecting resilient wing formed therein, and two forwardly projecting arms extending roughly parallel to one another from either side of the body, each arm having an aperture for engaging the nodule in one of the recesses such that the resilient wings abut the ends of the basal portion of said cover plate when said clips are disposed thereon.

7. The bracket assembly of claim 6, wherein:

said actuator means comprises a circuit breaker handle or toggle extending through the rectangular opening of said cover plate.

8. The bracket assembly of claim 6, wherein:

the rectangular opening has two side walls extending upwardly therefrom; and said actuator means comprises a rocker pivotably mounted in the rectangular opening, said rocker defining projecting integrally formed axle portions received in aligned apertures provided for them in the walls defining the apertures, said rocker having a depending yoke integrally formed therein and the yoke having laterally spaced legs that define downwardly open slots aligned with one another.

* * * * *